US011137235B2

(12) United States Patent
Fischer

(10) Patent No.: US 11,137,235 B2
(45) Date of Patent: Oct. 5, 2021

(54) BROADHEAD FOR BOW HUNTING

(71) Applicant: Dean Fischer, Norwalk, OH (US)

(72) Inventor: Dean Fischer, Norwalk, OH (US)

( * ) Notice: Subject to any disclaimer, the term of this patent is extended or adjusted under 35 U.S.C. 154(b) by 0 days.

(21) Appl. No.: 16/808,767

(22) Filed: Mar. 4, 2020

(65) Prior Publication Data

US 2020/0284562 A1 Sep. 10, 2020

Related U.S. Application Data

(60) Provisional application No. 62/813,209, filed on Mar. 4, 2019.

(51) Int. Cl.
*F42B 6/08* (2006.01)

(52) U.S. Cl.
CPC ..... *F42B 6/08* (2013.01)

(58) Field of Classification Search
CPC ..... F42B 6/08; F42B 12/34
USPC ..... 473/583
See application file for complete search history.

(56) References Cited

U.S. PATENT DOCUMENTS 2,820,634 A * 1/1958 Vance ..... F42B 6/08 473/583
3,138,383 A * 6/1964 McKinzie ..... F42B 6/08 473/583
3,578,328 A * 5/1971 Rickey ..... F42B 6/08 473/583
4,166,619 A * 9/1979 Bergmann ..... F42B 12/362 30/161
5,046,744 A * 9/1991 Eddy ..... F42B 6/08 473/583
5,178,398 A * 1/1993 Eddy ..... F42B 6/08 473/583
5,458,341 A * 10/1995 Forrest ..... F42B 6/08 473/583
5,803,844 A * 9/1998 Anderson ..... F42B 6/08 473/583
6,322,464 B1 * 11/2001 Sestak ..... F42B 6/08 473/583
6,517,454 B2 * 2/2003 Barrie ..... F42B 6/08 473/583

(Continued)

OTHER PUBLICATIONS

Rocket Broadheads: https://rocketbroadheads.com/product/ar100ms/.

(Continued)

*Primary Examiner* — Alexander R Niconovich
(74) *Attorney, Agent, or Firm* — Shumaker, Loop & Kendrick, LLP; James D. Miller

(57) ABSTRACT

A broadhead assembly includes a ferrule having a first shaft and a second shaft extending across an opening formed through the ferrule. A first blade having a first slot and a second slot is disposed in the opening of the ferrule with the first shaft disposed through the first slot of the first blade and the second shaft disposed through the second slot of the first blade. A second blade having a first slot and a second slot is also disposed in the opening of the ferrule with the first shaft disposed through the first slot of the second blade and the second shaft disposed through the second slot of the second blade. An O-ring extends around the first blade and the second blade and is configured to fail when the broadhead assembly is actuated from a first position to a second position.

15 Claims, 3 Drawing Sheets

(56) References Cited

U.S. PATENT DOCUMENTS 6,669,586 B2 * 12/2003 Barrie ..... F42B 6/08 473/583
7,771,298 B2 * 8/2010 Pulkrabek ..... F42B 6/08 473/583
7,905,802 B2 * 3/2011 Erhard ..... F42B 6/08 473/583
8,147,361 B1 * 4/2012 Weaver ..... F42B 6/08 473/583
8,272,979 B1 * 9/2012 Cooper ..... F42B 6/08 473/583
8,905,874 B2 * 12/2014 Sullivan ..... F42B 12/34 473/583
8,911,311 B1 * 12/2014 Mizek ..... F42B 6/08 473/583
8,915,808 B2 * 12/2014 Powell ..... H04N 13/366 473/583
8,986,141 B2 * 3/2015 Pedersen ..... F42B 12/34 473/583
9,170,078 B2 * 10/2015 Pedersen ..... F42B 6/08
9,372,056 B2 * 6/2016 Sullivan ..... F42B 6/08
9,903,693 B2 * 2/2018 Salvino ..... F42B 6/08
9,945,647 B2 * 4/2018 Pugliese ..... F42B 6/08
10,309,754 B2 * 6/2019 Pugliese ..... F42B 12/34
10,598,470 B1 * 3/2020 Sanford ..... F42B 6/08
10,619,982 B2 * 4/2020 Romero ..... F42B 6/08
10,623,808 B2 * 4/2020 Pedersen ..... F42B 6/08
2013/0303315 A1 * 11/2013 Peetz ..... F42B 12/385 473/581
2020/0103208 A1 * 4/2020 Sanford ..... F42B 6/08

OTHER PUBLICATIONS

Havoc 2-Blade Expandable 100GR Broadhead: https://shop.g5outdoors.com/havoc-2-blade-expandable-100gr-broadhead/.

* cited by examiner

BROADHEAD FOR BOW HUNTING

CROSS-REFERENCE TO RELATED APPLICATION

This patent claims priority to U.S. Provisional Patent Application Ser. No. 62/813,209, filed on Mar. 4, 2019, the entire disclosure of which is hereby incorporated herein by reference.

FIELD OF THE INVENTION

The present invention relates to a broadhead for use in bow hunting, and more particularly, a broadhead having a pair of blades configured to rotate outwardly in opposing rotational directions when the broadhead strikes and penetrates a target.

BACKGROUND OF THE INVENTION

Broadheads for use in bow hunting are known to include multiple different segments that expand upon contact with a target and subsequent penetration thereof. For example, such broadheads may include two, three, or four different segments that change orientation during the process of entering and passing through the target. The target may be prey intended to be penetrated by the broadhead, as one example. The expansion of the segments may be intended to prevent undesired removal of the arrow from the prey. The expansion of the segments may also be relied upon for increasing the amount of damage done to the prey as a result of the exposure of additional cutting surfaces during the expansion of the segments.

However, these expanding broadheads typically include complex mechanisms for carrying out the aforementioned expansion process. Such mechanisms may include multiple moving parts, complex part geometries, or releasable biasing elements for reconfiguring the mechanism during the expansion process.

There accordingly exists a need in the art for an improved broadhead having a simplified geometry and minimal moving parts while maintaining the ability to expand outwardly during the process of penetrating a target.

SUMMARY OF THE INVENTION

Compatible and attuned with the present invention, an improved broadhead assembly having fewer components and a simplified structure has surprisingly been discovered.

According to an embodiment of the invention, a broadhead assembly includes a ferrule, a first blade rotatably and slidably coupled to the ferrule, and a second blade rotatably and slidably coupled to the ferrule. The broadhead assembly is configured to actuate from a first position to a second position during a penetrating of a target.

Accordingly to another embodiment of the invention, a broadhead assembly is configured to actuate from a first position to a second position during a penetrating of a target. The broadhead assembly comprises a ferrule having a first shaft and a second shaft extending across an opening formed through the ferrule. A first blade has a first slot and a second slot, the first shaft disposed through the first slot of the first blade and the second shaft disposed through the second slot of the first blade with the first slot of the first blade extending rectilinearly and the second slot of the first blade including a rectilinear segment and an arcuate segment. A second blade has a first slot and a second slot, the first shaft disposed through the first slot of the second blade and the second shaft disposed through the second slot of the second blade with the first slot of the second blade extending rectilinearly and the second slot of the second blade including a rectilinear segment and an arcuate segment. An O-ring extends around the first blade and the second blade when the broadhead assembly is in the first position.

BRIEF DESCRIPTION OF THE DRAWINGS

The above, as well as other objects and advantages of the invention, will become readily apparent to those skilled in the art from reading the following detailed description of an embodiment of the invention when considered in the light of the accompanying drawings.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
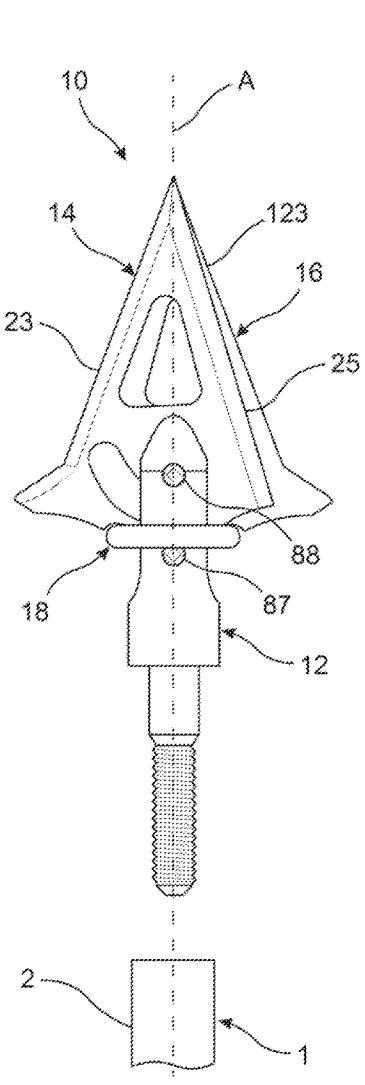
FIG. 1 is a partially exploded fragmentary top plan view of a broadhead assembly according to an embodiment of the invention.

FIG. 1 illustrates a broadhead assembly 10 according to an embodiment of the present invention, wherein the broadhead assembly 10 is configured for coupling to the end of a shaft 2 of an arrow 1. The broadhead assembly 10 is configured to expand during the process of penetrating a target 5 (FIGS. 6-9). The target 5 may be prey being hunted using the broadhead assembly 10, but the beneficial features of the present invention may be appreciated with respect to a variety of different materials capable of being penetrated by the broadhead assembly 10. The expansion of the broadhead assembly 10 includes an adjustment of the broadhead assembly 10 from a first position corresponding to a configuration of the broadhead assembly 10 prior to making contact with the associated target 5 to a second position corresponding to a configuration of the broadhead assembly 10 after fully reacting to any forces present between the broadhead assembly 10 and the target 5 during the penetration thereof.

The broadhead assembly 10 generally includes a ferrule 12, a first blade 14 rotatably and slidably coupled to the ferrule 12, a second blade 16 rotatably and slidably coupled to the ferrule 12, and an O-ring 18 extending around the ferrule 12 and the first and second blades 14, 16. The aforementioned expansion of the broadhead assembly 10 is achieved by a sliding and a rotating of the first and second blades 14, 16 relative to the ferrule 12 during the process of the blades 14, 16 initially contacting and subsequently penetrating the desired target 5. The O-ring 18 is configured to maintain the broadhead assembly 10 in the first position prior to making contact with the target 5 and to subsequently release the blades 14, 16 to rotate towards the second position during the penetration of the target 5.

The broadhead assembly 10 includes a central longitudinal axis A that coincides with a central longitudinal axis of the shaft 2 of the arrow 1 to which the broadhead assembly 10 is coupled. Thus, during flight of the arrow 1 the central longitudinal axis A of the broadhead assembly 10 further coincides (is aligned) with a vector defining the direction of travel of the arrow 1, hence further references to the direction of travel of the arrow 1 hereinafter should be understood to refer to a direction parallel to the central longitudinal axis A of the broadhead assembly 10. In view of the preceding, any references hereinafter to the axial direction of the broadhead assembly 10 also refer to the directions arranged parallel to the central longitudinal axis A. In contrast, references hereinafter to a radial direction of the broadhead assembly 10 refer to those directions arranged perpendicular to the central longitudinal axis A while passing therethrough. A rotation of either of the blades 14, 16 from the configuration shown in FIG. 1 therefore results in a longitudinal axis B, C of either respective blade 14, 16 being changed from an orientation arranged parallel to the central longitudinal axis A to an orientation arranged transverse to the central longitudinal axis A and extending at least partially in the radial direction of the broadhead assembly 10.

Figure 2:
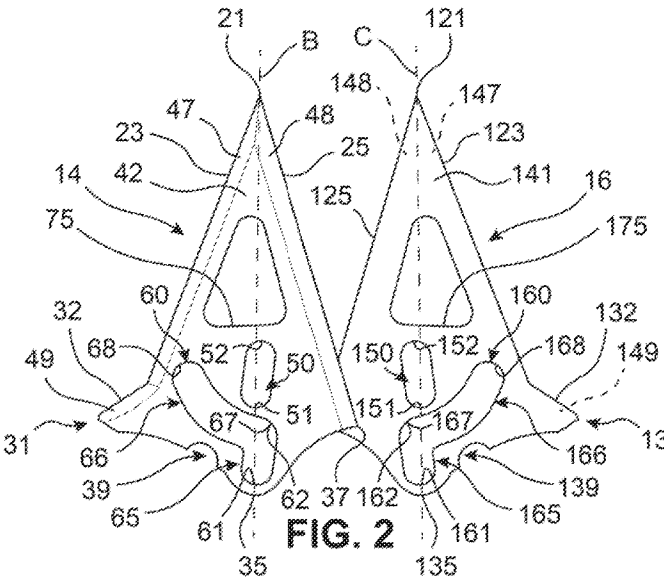
FIG. 2 is a top plan view showing a pair of blades of the broadhead assembly in isolation, wherein the blades are illustrated to include only a partial overlap to better illustrate the features of the rearwardly disposed blade.

Referring now to FIG. 2, the first blade 14 and the second blade 16 are shown from the same perspective as FIG. 1, but are illustrated as being separated from each other in a direction perpendicular to the longitudinal axes B, C thereof in order to visually expose the portions of the second blade 16 that are obscured by the first blade 14 as shown in FIG. 1. The direction perpendicular to the longitudinal axis B, C of each of the blades 14, 16 is hereinafter referred to as the lateral direction of each of the blades 14, 16, which is shown in the left and right directions with respect to FIGS. 1 and 2.

The first blade 14 includes a first pointed tip 21 formed at the intersection of a first edge 23 and a second edge 25 thereof. The longitudinal axis B of the first blade 14 extends from the pointed tip 21 to a distally arranged base surface 35 of the first blade 14 to cause the longitudinal axis B to be arranged parallel to and to substantially coincide with the central longitudinal axis A of the broadhead assembly 10 when the broadhead assembly 10 is in the aforementioned first position.

The first edge 23 is disposed to a first side of the longitudinal axis B while the second edge 25 is disposed to a second opposing side of the longitudinal axis B. The first edge 23 is arranged at a first angle relative to the longitudinal axis B while the second edge 25 is arranged at a second angle relative to the longitudinal axis B. The first and second angles are each acute angles, but the second angle is always selected to be smaller than the first angle. In the provided embodiment, the first angle is about 21 degrees while the second angle is about 18 degrees. However, one skilled in the art should appreciate that alternative angles may be used for the first and second angles so long as the second angle is an acute angle that is also smaller than the first angle.

The first edge 23 extends away from the first pointed tip 21 while tapering outwardly until reaching a lateral projection 31 of the first blade 14. The lateral projection 31 is formed by a portion of the first blade 14 disposed at a maximum distance from the longitudinal axis B of the first blade 14 in the aforementioned lateral direction of the first blade 14. The lateral projection 31 includes an engaging edge 32 extending away from the end of the first edge 23 disposed opposite the first pointed tip 21 with the engaging edge 32 extending at least partially in the lateral direction of the first blade 14.

Specifically, the engaging edge 32 is disposed at a third angle relative to the longitudinal axis B. The third angle is selected to be an angle that is larger than the first angle to form a substantially V-shaped concave surface at the intersection of the first edge 23 and the engaging edge 32. In the provided embodiment the third angle is about 60 degrees, but one skilled in the art should appreciate that alternative angles may be utilized for the third angle without necessarily departing from the scope of the present invention so long as the third angle is greater than the first angle to cause the engaging edge 32 to extend laterally outwardly of the first edge 23 relative to the longitudinal axis B.

The base surface 35 of the first blade 14 extends between and connects the engaging edge 32 and the second edge 25 at an end of the first blade 14 opposite the first pointed tip 21. A second pointed tip 37 is formed at an intersection of an end of the second edge 25 disposed opposite the first pointed tip 21 and an end of the base surface 35 disposed opposite the lateral projection 31. The second pointed tip 37 is oriented to point at least partially in a direction away from the direction of travel of the arrow 1 and at least partially in the radial direction of the broadhead assembly 10 when the broadhead assembly 10 is in the first position. The base portion 35 further includes a retaining groove 39 formed therein at a position disposed between the longitudinal axis B and the end of the base surface 35 intersecting the engaging edge 32 of the lateral projection 31. The retaining groove 39 may include a substantially semi-circular and concave shape indented into the base surface 35 towards the first pointed tip 21 thereof. The retaining groove 39 is configured to receive a portion of the O-ring 18 therein for securing a rotational position of the first blade 14 relative to the ferrule 12 when the broadhead assembly 10 is in the first position.

Figure 3:
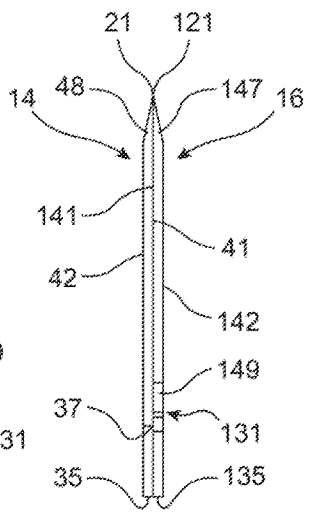
FIG. 3 is a side elevational view of the pair of the blades of FIG. 2.

Referring now to FIG. 3, the first blade 14 includes an inner face 41 facing towards the second blade 16 and a parallel arranged outer face 42 facing away from the second blade 16, wherein the thickness direction of the first blade 14 is measured between the inner face 41 and the outer face 42. The inner face 41 is formed on a plane that also coincides with a plane occupied by each of the first edge 23, the second edge 25, and the engaging edge 32, wherein the common plane is also arranged parallel to the central longitudinal axis A of the broadhead assembly 10 as well as the longitudinal axis B of the first blade 14.

As best shown in FIGS. 2 and 3, the outer face 42 is indented relative to the inner face 41 adjacent each of the aforementioned edges 23, 25, 32 to form each of a first facet 47, a second facet 48, and an engaging facet 49 around a portion of a periphery of the first blade 14. Each of the facets 47, 48, 49 is provided as a sloped surface connecting the inner face 41 to the outer face 42 about the portion of the periphery of the first blade 14.

The first facet 47 is arranged at an angle relative to the inner and outer faces 41, 42 while connecting the inner face 41 to the outer face 42 along the first edge 23. The first edge 23 is accordingly formed at the intersection of the first facet 47 and the inner face 41, wherein the first facet 47 and the inner face 41 are arranged at an acute angle relative to each other. In the provided embodiment, the first facet 47 is disposed at an angle of about 12 degrees relative to the inner face 41, but alternative acute angles may be selected for the slope of the first facet 47 without departing from the scope of the present invention.

The second facet 48 is arranged at an angle relative to the inner and outer faces 41, 42 while connecting the inner face 41 to the outer face 42 along the second edge 25. The second edge 25 is accordingly formed at the intersection of the second facet 48 and the inner face 41, wherein the second facet 48 and the inner face 41 are arranged at an acute angle relative to each other. In the provided embodiment, the second facet 48 is disposed at an angle of about 12 degrees relative to the inner face 41, but alternative angles may be selected for the slope of the second facet 48 without departing from the scope of the present invention.

Lastly, the engaging facet 49 is arranged at an angle relative to the inner and outer faces 41, 42 while connecting the inner face 41 to the outer face 42 along the engaging edge 32. The engaging edge 32 is accordingly formed at the intersection of the engaging facet 49 and the inner face 41, wherein the engaging facet 49 and the inner face 41 are arranged at an acute angle relative to each other. In the provided embodiment, the engaging facet 49 is disposed at an angle of about 12 degrees relative to the inner face 41, but alternative angles may be selected for the slope of the engaging facet 49 without departing from the scope of the present invention.

The acute angle formed between each of the respective facets 47, 48, 49 and the inner face 41 of the first blade 14 results in each of the disclosed edges 23, 25, 32 (and hence each of the disposed pointed tips 21, 37) having a desired sharpness for cutting the target 5 in a manner necessarily to facilitate entry of the broadhead assembly 10 therein and subsequent motion of the blades 14, 16 during adjustment of the broadhead assembly 10 between the first and second positions. The manner in which each of the facets 47, 48, 49 is sloped relative to the direction of travel of the arrow 1 also aids in facilitating the adjustment of the broadhead assembly 10 from the first position to the second position due to the forces present between the facets 47, 48, 49 and any portions of the target 5 engaging the facets 47, 48, 49 while the broadhead assembly 10 is passing through the target 5, as explained in greater detail hereinafter when describing operation of the broadhead assembly 10.

The facets 47, 48, 49 are each shown and described herein as being formed as single bevel facets, but one skilled in the art should appreciate that each of the facets 47, 48, 49 may alternatively be provided as any type of facet configuration such as a double bevel edge without necessarily departing from the scope of the present invention. Additionally, each of the edges 23, 25, 32 may further be provided with additional features such as serrations or the like without necessarily departing from the scope of the present invention, so long as the selected facet configuration and any selected additional features are configured for slicing through the desired target 5 in a desired manner.

The first blade 14 further includes each of a first slot 50 and a second slot 60 formed therethrough, each of which penetrate through the first blade 14 from the inner face 41 to the outer face 42 thereof. The first slot 50 is disposed adjacent a central portion of the first blade 14 and extends rectilinearly from a first end 51 to a second end 52 thereof. The direction of extension of the first slot 50 is primarily in the longitudinal direction of the first blade 14 with the first end 51 disposed towards the base surface 35 and the second end 52 disposed towards the first pointed tip 21. As used herein, the phrase "primarily in the longitudinal direction" indicates a direction extending at least partially in the longitudinal direction while arranged at an angle of less than 45 degrees relative thereto. In the present case, the first slot 50 is disposed at a relatively small acute angle relative to the longitudinal axis B with the first end 51 disposed directly on the longitudinal axis B and the second end 52 offset slightly from the longitudinal axis and disposed towards the second pointed tip 37 with respect to the lateral direction of the first blade 14. The angle of inclination of the first slot 50 may be selected to be between 0 and 15 degrees relative to the longitudinal axis B, as desired. In the illustrated embodiment, the angle of inclination of the first slot is about 8 degrees.

The second slot 60 is disposed between the first slot 50 and the base surface 35 and includes a rectilinear segment 65 and an arcuate segment 66. The rectilinear segment 65 is arranged parallel to the first slot 50 and extends from a first end 61 to a second end 62 thereof. The rectilinear segment 65 extends primarily in the longitudinal direction of the first blade 14 with the first end 61 disposed towards the base surface 35 and the second end 62 disposed towards the first pointed tip 21. However, the rectilinear segment 65 is arranged at the same acute angle relative to the longitudinal axis B as is the first slot 50 with the first end 61 disposed directly on the longitudinal axis B and the second end 62 offset slightly from the longitudinal axis B and disposed towards the second pointed tip 37 with respect to the lateral direction of the first blade 14. The angle of inclination of the rectilinear segment 65 may accordingly be selected to be between 0 and 15 degrees in similar fashion to the first slot 50, including the illustrated angle of inclination of about 8 degrees.

The arcuate segment 66 is continuous with the rectilinear segment 65 and extends from a first end 67 to a second end 68 thereof, wherein the first end 67 of the arcuate segment 66 coincides with the second end 62 of the rectilinear segment 65. The arcuate segment 66 has the shape of a segment of a circle with a radius of curvature of the arcuate segment 66 measured between the second end 52 of the first slot 50 and each point disposed along a centerline of the arcuate segment 66. The arcuate segment 66 extends laterally away from the rectilinear segment 65 in a direction towards the lateral projection 31 of the first blade 14.

The first blade 14 may optionally include a central opening 75 passing through the first blade 14 from the inner face 41 to the outer face 42. The central opening 75 may have any desired perimeter shape and may be provided in order to prescribe a desired weight to the first blade 14 or to reduce the amount of material necessary for forming the broadhead assembly 10 while maintaining the beneficial features disclosed herein.

As should be apparent from a review of FIGS. 1-3, the first blade 14 and the second blade 16 include substantially identical structure, but the second blade 16 is rotated 180 degrees about the central longitudinal axis A relative to the first blade 14 when the broadhead assembly 10 is placed in the first position. The identical structure present between the first and second blades 14, 16 results in the second blade 16 having each of the features shown and described with reference to the first blade 14, wherein these identical features of the second blade 16 are denoted by reference numerals that are 100 greater than the corresponding reference numerals disclosed with reference to the first blade 14.

This 180 degrees of relative rotation between the first blade 14 and the second blade 16 results in each of the features of the first blade 14 being equally spaced from the central longitudinal axis A as are the corresponding features of the second blade 16, but with each of the features of the first blade 14 formed to an opposite lateral side of the central longitudinal axis A from the perspective of FIG. 1. This results in the assembly including the first and second blades 14, 16 having a profile that is substantially symmetric relative to the central longitudinal axis A with the first blade 14 corresponding to the portion of the profile present to a first lateral side of the central longitudinal axis A (left side as illustrated in FIG. 1) and the second blade 16 corresponding to the portion of the profile present to an opposing second lateral side of the central longitudinal axis A (right side as illustrated in FIG. 1). The features of the first blade 14 described as being disposed at an angle relative to the longitudinal axis B thereof are similarly present in the second blade 16 and are disposed at the same angle relative to the longitudinal axis C thereof, but extend away from the longitudinal axis C in a lateral direction opposite the features of the first blade 14. The 180 degree rotation of the second blade 16 relative to the first blade 14 also results in the inner face 141 of the second blade 16 facing towards the inner face 41 of the first blade 14 while the corresponding outer faces 42, 142 are facing away from each other.

As can be seen in FIG. 1, the placement of the broadhead assembly 10 in the first position includes the first pointed tip 21 of the first blade 14 positioned to contact and substantially coincide with the first pointed tip 121 of the second blade 16. This results in the first and second facets 47, 48 of the first blade 14 and the first and second facets 147, 148 of the second blade 16 all intersecting at a forwardmost position of the broadhead assembly 10 with respect to the direction of travel of the corresponding arrow 1. This results in a sharp tip to the broadhead assembly 10 as a whole when initially contacting the desired target 5.

The longitudinal axis C of the second blade 16 is arranged parallel to and substantially coincides with the central longitudinal axis A of the broadhead assembly 10 as well as the longitudinal axis B of the first blade 14. The longitudinal axes B, C are also aligned with each other with respect to the lateral direction of each of the blades 14, 16 when the broadhead assembly 10 is in the first position.

The blades 14, 16 are also positioned relative to each other when in the first position in a manner allowing for each of the second edges 25, 125 to be indented inwardly from a corresponding one of the first edges 21, 121 to protect each of the second edges 25, 125 from undesired contact with the target 5 prior to the adjustment of the broadhead assembly 10 towards the second position. For example, as can be seen in FIG. 1, the smaller angle of inclination of the second edge 25 of the first blade 14 in comparison to the angle of inclination of the first edge 123 of the second blade 16 allows for the second edge 25 to be angularly displaced inwardly from the first edge 123 with an increasing lateral gap present between the second edge 25 and the first edge 123 when progressing away from the coinciding first pointed tips 21, 121. This same relationship is present between the first edge 23 of the first blade 14 and the second edge 125 of the second blade 16 on an opposite side of the broadhead assembly 10 from that illustrated in FIG. 1. These relationships result in only the outermost disposed first edges 23, 123 being exposed as cutting surfaces during the initial penetration of the target 5 while the broadhead assembly 10 remains in the first position, thereby preserving the sharpness of the second edges 25, 125 until they are deployed during the rotation of the blades 14, 16 towards the second position.

Figure 5:
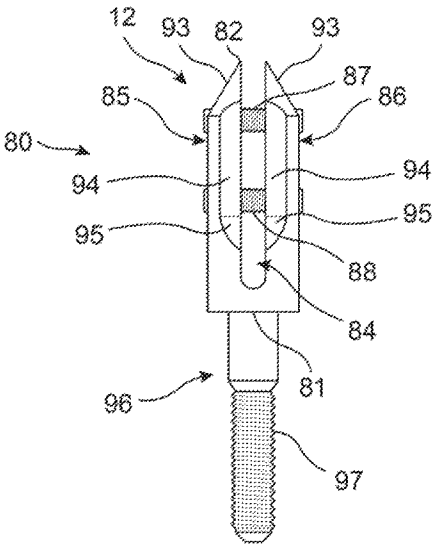
FIG. 5 is a side elevational view of the ferrule of FIG. 4.
Figure 4:
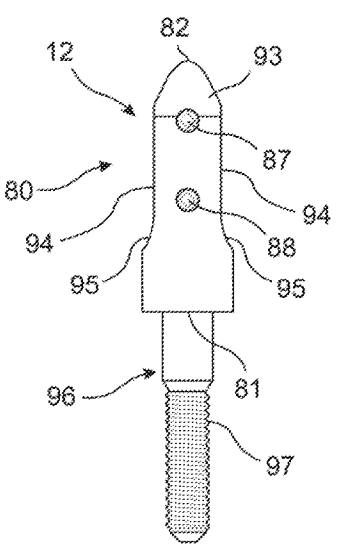
FIG. 4 is a top plan view showing a ferrule of the broadhead assembly in isolation.

Referring now to FIGS. 4 and 5, the ferrule 12 generally includes a cylindrical body 80 and a coupling feature 96. The cylindrical body 80 extends from a first end 81 to a second end 82, wherein the second end 82 is disposed towards the first pointed tips 21, 121 of the first and second blades 14, 16 when the broadhead assembly 10 is in the first position. The coupling feature 96 is disposed at the first end 81 of the cylindrical body 80 and is configured to engage with a corresponding feature of the shaft 2 of the arrow 1. In the illustrated embodiment, the coupling feature 96 is provided as a cylindrical threaded body 97 configured to engage with a corresponding threaded opening (not shown) formed within the shaft 2 to securely couple the ferrule 12 to the arrow 1. However, one skilled in the art will appreciate that any type of coupling feature 96 capable of securely coupling the ferrule 12 to the arrow 1 may be utilized, as desired, without departing from the scope of the present invention. It should also be understood that the ferrule 12 may otherwise be joined to the shaft 2 of the arrow 1 using a suitable joining method, as desired.

The cylindrical body 80 includes an axially extending opening 84 penetrating the cylindrical body 80 at the second end 82 thereof and extending towards the first end 81 thereof, wherein the axially extending slot further extends across diametrically opposing portions of an outer circumferential surface of the cylindrical body 80. The axially extending opening 84 divides the cylindrical body 80 into a first segment 85 and an opposing second segment 86. The first segment 85 is spaced from the second segment 86 across the opening 84 by a distance substantially equal to or slightly greater than a combined thickness of the first and second blades 14, 16 as measured between the opposing outer faces 42, 142 thereof. The spacing of the first segment 85 from the second segment 86 may be selected to provide a frictional fit between the blades 14, 16 and the opposing inner surfaces defining the opening 84 in order to prevent undesired motion of the blades 14, 16 prior to the blades 14, 16 starting to actuate away from the first position during penetration of the target 5. Alternatively, the first and second segments 85, 86 may be spaced from each other by a distance greater than the combined thickness of the blades 14, 16 such that the blades 14, 16 substantially float within the opening 84 of the ferrule 12. This floating disposition of the blades 14, 16 may be selected in order to ensure that the frictional forces present between the blades 14, 16 and the adjoining segments 85, 86 of the ferrule 12 are not too great to potentially interfere with the actuation of the broadhead assembly 10 from the first position to the second position during the penetration of the target 5.

The second end 82 of the cylindrical body 80 is substantially conical in shape and includes a pair of tapered surfaces 93 formed on opposing sides of the axially extending opening 84 with each of the tapered surfaces 93 formed on one of the segments 85, 86 of the cylindrical body 80. The cylindrical body 80 further includes a pair of indented surfaces 94 formed on diametrically opposing portions of the cylindrical body 80 where the opening 84 penetrates the cylindrical body 80. Each of the indented surfaces 94 further includes a corresponding tapered surface 95 at an axial end of the opening 84 spaced distally from the second end 82 of the cylindrical body 80. Each of the disclosed surfaces 93, 94, 95 is provided in order to taper the ferrule 12 for ease of entry of the ferrule 12 into the target 5 during penetration thereof while also preventing an undesired removal of the O-ring 18 from the locking position thereof during flight of the broadhead assembly 10. More specifically, the outward tapering of the surfaces 95 ensures that the O-ring 18 is not dislodged in an axial direction of the ferrule 12 towards the shaft 2 of the arrow 1 during flight of the arrow 1 and then during an initial penetration of the broadhead assembly 10 into the desired target 5.

A first shaft 87 and a second shaft 88 extend across the opening 84 from the first segment 85 to the second segment 86 with the shafts 87, 88 arranged parallel to each other. As shown in FIG. 1, the shafts 87, 88 extend through a central portion of the cylindrical body 80 across diametrically opposing surfaces thereof in order to cause the shafts 87, 88 to each extend directly across and through the central longitudinal axis A of the broadhead assembly 10. The shafts 87, 88 are spaced from each other in the axial direction of the broadhead assembly 10 with the first shaft 87 disposed towards the first end 81 of the cylindrical body 80 and the second shaft 88 disposed towards the second end 82 thereof. The axial spacing present between the first shaft 87 and the second shaft 88 is substantially equal to an axial spacing present between the first ends 51, 151 of the first slots 50, 150 and the first ends 61, 161 of the second slots 60, 160. The shafts 87, 88 are illustrated as being threaded cylindrical bodies that may be fed through corresponding threaded openings formed through at least portions of each of the opposing segments 85, 86 to extend across the opening 84, as desired. However, one skilled in the art will appreciate that any substantially cylindrical shaft or rod may be disposed across the opening 84 at the illustrated and described location without necessarily departing from the scope of the present invention.

The first shaft 87 is configured to be disposed through the first slots 50, 150 of the blades 14, 16 while the second shaft 88 is configured to be disposed through the second slots 60, 160 thereof. As a result, each of the shafts 87, 88 includes an outer diameter that is smaller than a width across each of the slots 50, 150, 60, 160 in order to allow for the shafts 87, 88 to be slidably and rotatably disposed within each of the slots 50, 150, 60, 160 while having a slight degree of play therein in order to avoid a potential seizure of the blades 14, 16 when being repositioned. When the broadhead assembly 10 is in the first position the first shaft 87 is disposed through the first ends 51, 151 of the first slots 50, 150 while the second shaft 88 is disposed through the first ends 61, 161 of the rectilinear segments 65, 165 of the second slots 60, 160. The manner in which the first slots 50, 150 and the rectilinear segments 65, 165 of the second slots 60, 160 are angled away from each other tends to form a slight interference fit for preventing undesired motion of either of the shafts 87, 88 within any of the slots 50, 150, 60, 160 prior to contact with the target 5 due to the angled surfaces defining the slots 50, 150, 60, 160 extending at least partially in the lateral direction at a position forward of the shafts 87, 88 with respect to the direction of travel of the arrow 1.

When the broadhead assembly 10 is in the first position the O-ring 18 is also able to be slid over the base portions 35, 135 of the blades 14, 16 for entry into the opposing retaining grooves 39, 139. The O-ring 18 is formed from a resiliently elastic material allowing for outward stretching of the O-ring 18 when being placed into the retaining grooves 39, 139, wherein the resiliency of the material forming the O-ring 18 causes the O-ring 18 to attempt to retract around the blades 14, 16 in order to maintain the blades 14, 16 in the desired configuration. The O-ring 18 may be formed from an elastomeric material such as rubber, as desired.

The first position of the broadhead assembly 10 accordingly includes the blades 14, 16 being maintained in a desired configuration as a result of any friction present between the blades 14, 16 and the ferrule 12, the slight interference fit caused by the opposing angled portions of the slots 50, 150, 60, 160, and the resilient forces of the O-ring 18 attempting to retract around the adjoining blades 14, 16 when disposed within the retaining grooves 39, 139.

Figure 6:
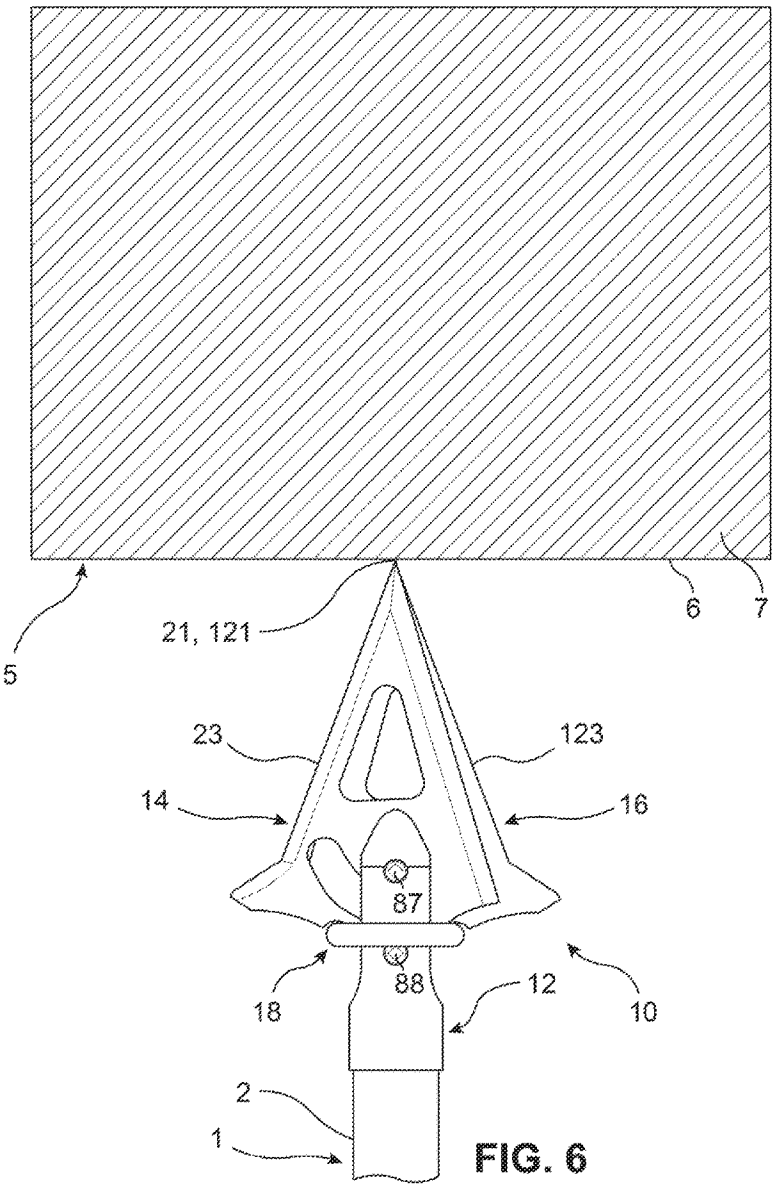
FIG. 6 is a top plan view illustrating an arrow having the broadhead assembly of FIG. 1 when first making contact with a target.

Referring now to FIGS. 6-9, a method of operation of the broadhead assembly 10 is disclosed. FIG. 6 illustrates the broadhead assembly 10 as being securely coupled to the shaft 2 of the arrow 1 immediately prior to making contact with an exemplary target 5. In the given example, the target 5 may be an animal acting as prey during a hunting expedition. As such, the target 5 is further illustrated as having an outer surface denoted by reference numeral 6 that is representative of the skin of the animal being penetrated and an interior portion 7 representative of the interior flesh of the animal. For the purposes of this example, it is assumed that the portions of the target 5 immediately adjacent the outer surface 6 thereof are more resistant to the penetration of the broadhead assembly 10 in comparison to the interior portion 7, in similar fashion to the manner in which the outer skin of an animal acting as prey typically includes more resistance to penetration than does the inwardly disposed flesh of the animal protected by the skin. This difference in density and hence ability to be penetrated between the different portions of the target 5 may aid in actuating the broadhead assembly 10 between the first position and the second position as explained hereinafter. However, one skilled in the art should appreciate that the present invention can operate in the manner generally disclosed regardless of the presence of a hardened outer skin on the target 5.

Figure 7:
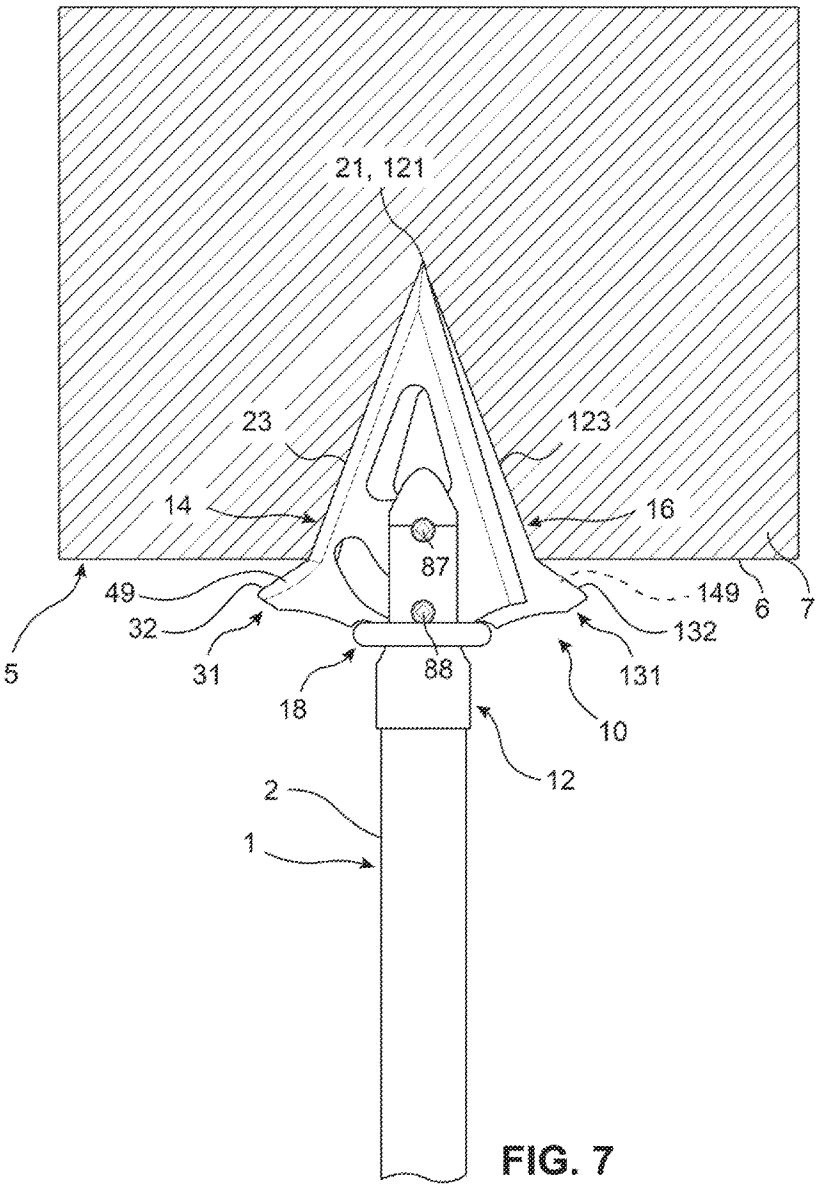
FIG. 7 is a top plan view illustrating the blades of the broadhead assembly partially penetrating the target.

FIG. 7 illustrates the broadhead assembly 10 after having penetrated the outer surface 6 of the target 5 to an extent wherein the lateral projections 31, 131 associated with each of the blades 14, 16 are about to make contact with the outer surface 6. Up until this point the penetration of the target 5 is primarily accomplished via the exposed first pointed tips 21, 121 and first edges 23, 123 defining the outer profile of the broadhead assembly 10 cutting through the outer surface 6 and then the interior portion 7 of the target 5. The penetration of the target 5 occurs with respect to the axial direction of the broadhead assembly 10 and hence the direction of travel of the arrow 1. The resistance of the target 5 to axial penetration thereof accordingly applies a force to the blades 14, 16 that is disposed opposite the direction of travel of the arrow 1. Specifically, the manner in which the first and second facets 47, 48, 147, 148 of each of the blades 14, 16 are sloped relative to the direction of travel of the arrow 1 causes a resulting force between the facets 47, 48, 147, 148 and the target 5 to be at least partially in the direction opposite the direction of travel of the arrow 1. This force acting against the direction of travel of the blades 14, 16 causes the blades 14, 16 to slide relative to the first and second shafts 87, 88. The first shaft 87 moves from a position disposed through the first ends 51, 151 of the first slots 50, 150 to a position disposed through the second ends 52, 152 of the first slots 50, 150. Concurrently, the second shaft 88 also moves from a position disposed through the first ends 61, 161 of the rectilinear segments 65, 165 of the second slots 60, 160 to a position disposed through the second ends 62, 162 of the rectilinear segments 65, 165 of the second slots 60, 160, which also coincides with the second shaft 88 being disposed through the first ends 67, 167 of the arcuate segments 66, 166 of the second slots 60, 160. The blades 14, 16 are accordingly slid axially towards the shaft 2 of the arrow 1 as a result of the resistance of the target 5 to the axial penetration of the blades 14, 16. The O-ring 18 is maintained around the blades 14, 16 during the axial motion thereof. The position of the broadhead assembly 10 shown in FIG. 7 is referred to hereinafter as the intermediate position of the broadhead assembly 10 which occurs immediately prior to actuation of the broadhead assembly 10 towards the aforementioned second and final position thereof.

Figure 9:
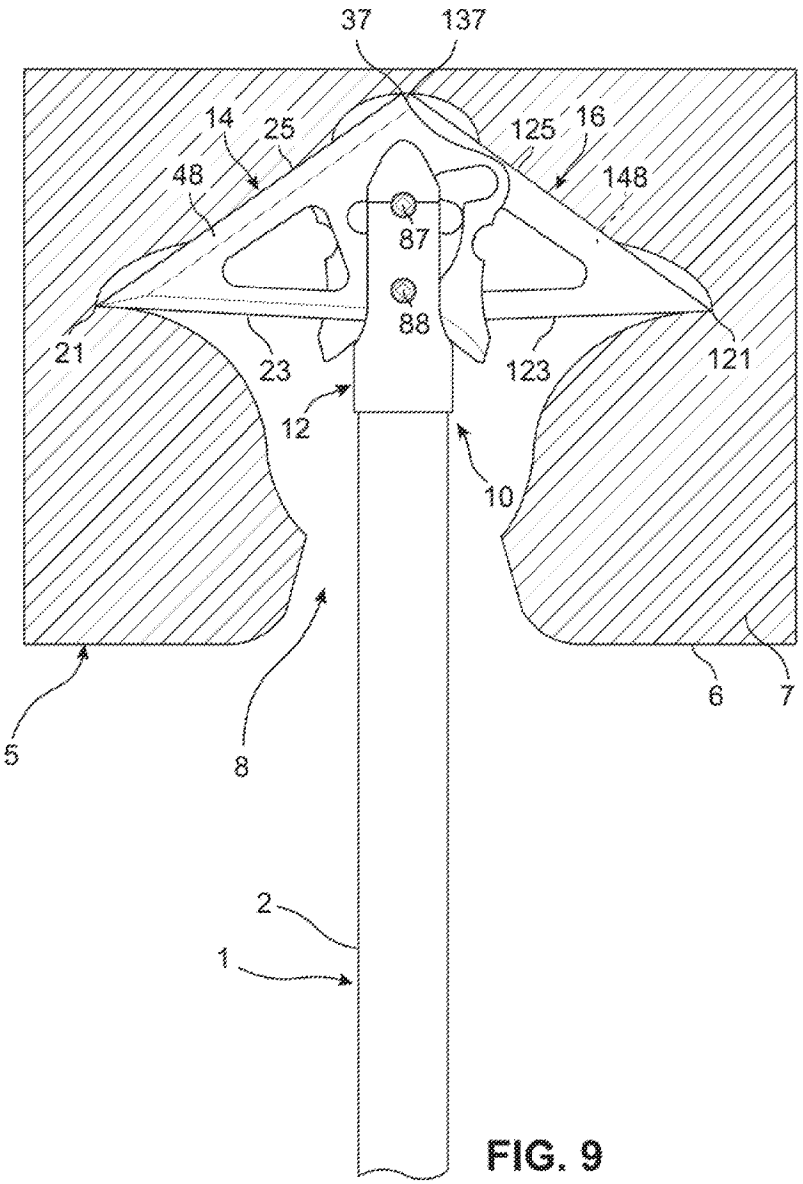
FIG. 9 is a top plan view illustrating the broadhead assembly in the fully inverted position after having penetrated the target.
Figure 8:
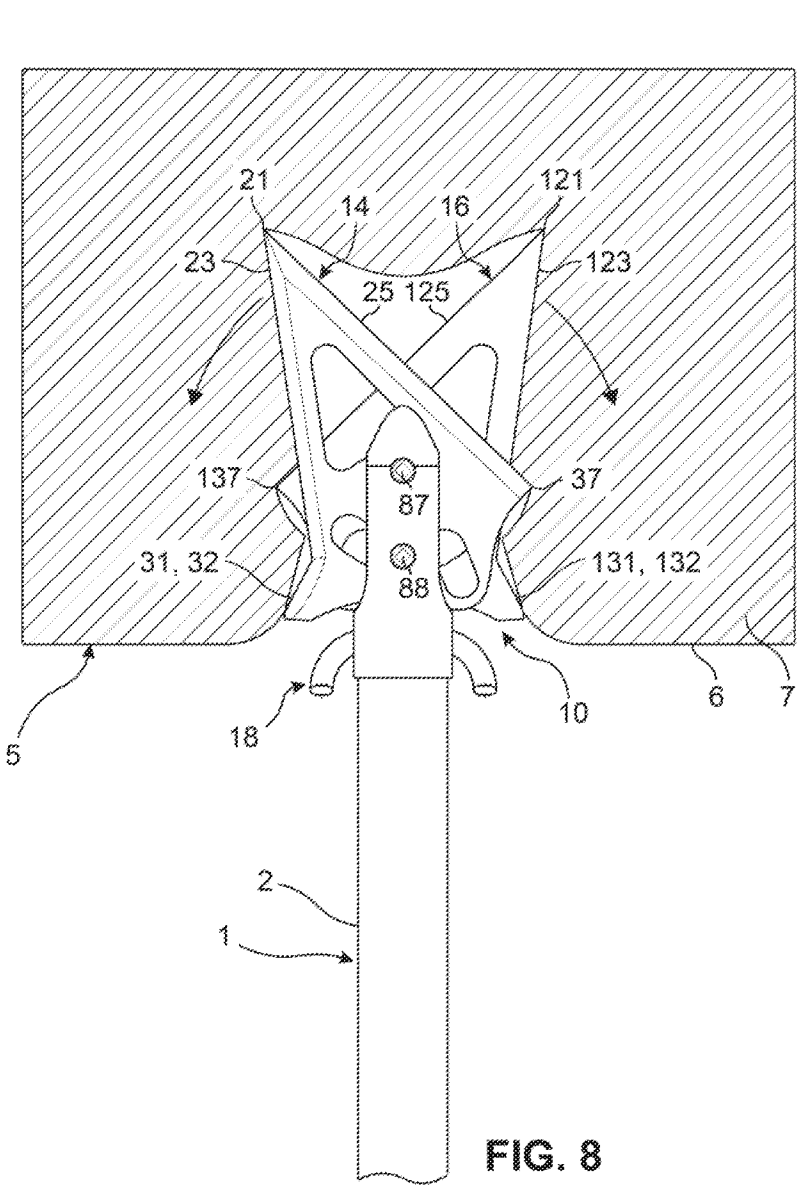
FIG. 8 is a top plan view illustrating the blades of the broadhead assembly slidably pivoting towards an inverted position during continued penetration of the target.

The engaging edges 32, 132 and the engaging facets 49, 149 of the opposing lateral projections 31, 131 eventually encounter the outer surface 6 of the target 5. The increased resistance offered by the outer surface 6 of the target 5 causes the blades 14, 16 to attempt to rotate away from the axially aligned configuration shown in FIG. 7 with respect to the intermediate position and towards the second position wherein the blades 14, 16 are rotated fully away from the axially aligned position of FIG. 7. The manner in which second shaft 88 is disposed through the first ends 67, 167 of the arcuate segments 66, 166 of the second slots 60, 160 when in the intermediate position provides a pathway for the second shaft 88 to traverse towards the second ends 68, 168 of the arcuate segments 66, 166 during rotation of the blades 14, 16, as best shown in FIG. 8. Specifically, the first shaft 87 disposed through the second end 52 of the first slot 50 of the first blade 14 forms an axis of rotation for the first blade 14 while the second shaft 88 traverses the arcuate segment 66 of the second slot 60 of the first blade 14 from the first end 67 to the second end 68 thereof. Similarly, the first shaft 87 disposed through the second end 152 of the first slot 150 of the second blade 16 forms an axis of rotation for the second blade 16 while the second shaft 88 traverses the arcuate segment 166 of the second slot 160 of the second blade 16 from the first end 167 to the second end 168 thereof. The manner in which the blades 14, 16 are mirrored relative to the central longitudinal axis A of the broadhead assembly 10 causes the blades 14, 16 to rotate in opposing rotational directions with the first pointed tips 21, 121 separating from each other to point at least partially in opposing radial directions of the broadhead assembly 10. The rotation of the blades 14, 16 from the intermediate position to the second position may also causes the O-ring 18 to be stretched outwardly until the O-ring 18 fails and falls away from the broadhead assembly 10, which in turn releases the blades 14, 16 to continue their rotation towards the second position. In other circumstances, the axial motion of the blades 14, 16 relative to the ferrule 12 during the penetration of the target 5 may cause the O-ring 18 to slide axially towards the shaft 2 of the arrow 1 in a manner causing the O-ring 18 to otherwise release the blades 14, 16 to begin their rotation without necessarily requiring a failure of the O-ring 18. The blades 14, 16 are capable of continuing this rotation until the second shaft 88 encounters the second end 68, 168 of each of the corresponding arcuate segments 66, 166 of the second slots 60, 160, which corresponds to the broadhead assembly 10 reaching the second position as illustrated in FIG. 9.

It has been surprisingly discovered that the slight angle present in the first slots 50, 150 and the rectilinear segments 65, 165 of the second slots 60, 160 relative to the direction of travel of the arrow 1 aids in avoiding any type of seizure of the blades 14, 16 that may prevent the blades 14, 16 from fully actuating to the second position in the manner illustrated herein. Specifically, the shafts 87, 88 strike the angled surfaces defining each of the slots 50, 150, 60, 160 in a manner that jolts the blades 14, 16 to overcome any frictional forces that may be present between the blades 14, 16 and the adjacent segments 85, 86 of the cylindrical body 80. The angling of the rectilinear portions of the slots 50, 150, 60, 160 also tends to apply a slight force to the blades 14, 16 that biases the blades 14, 16 to continue to rotate towards the second position when the lateral projections 31, 131 encounter the target 5 and the O-ring 18 eventually fails or slides axially to a position allowing for a release of the blades 14, 16 to rotate. However, it should be noted that the prescribed motion of the blades 14, 16 disclosed herein can still occur even in situations wherein the rectilinear portions of the slots 50, 150, 60, 160 are arranged in parallel to the direction of travel of the arrow 1.

The rotation of the blades 14, 16 from the intermediate position to the second position causes the exposed first edges 23, 123 and engaging edges 32, 132 to slice through the target 5 while progressively exposing the second edges 25, 125 from their previously indented positions relative to the first edges 23, 123. As shown in FIG. 9, the adjustment of the broadhead assembly 10 to the second position results in the second edges 25, 125 being exposed as the forwardmost cutting surfaces that are subsequently responsible for continuing to slice through the target 5 as the broadhead assembly 10 progresses in the direction of travel of the arrow 1. The second pointed tips 37, 137 are also rotated to a forwardmost position of the broadhead assembly 10 with respect to the direction of travel of the arrow 1 in similar fashion to the first pointed tips 21, 121 when the broadhead assembly 10 is initially in the first position. The delayed exposure of the second edges 25, 125 and the second pointed tips 37, 137 beneficially allows for fresh cutting surfaces to be exposed as the broadhead assembly 10 continues to penetrate the target 5 in order to ensure that the broadhead assembly 10 penetrates the target 5 to the greatest extent possible with respect to the direction of travel of the arrow 1. The second position may accordingly be alternatively referred to as an inverted position of the broadhead assembly 10 by virtue of the exposed edges and pointed tips of the blades 14, 16 being inverted from the initial positions thereof with respect to the first position.

As is apparent from review of FIGS. 6-9, the profile of the broadhead assembly 10 tends to narrow when the broadhead assembly 10 initially begins to actuate from the intermediate position to the second position before reaching a profile having a maximized width when at the second position. This narrowing and subsequent widening beneficially allows for an opening 8 formed through the target 5 as the result of the cutting of the broadhead assembly 10 to similarly narrow and then widen in a manner preventing ease of removal of the broadhead assembly 10 from the target 5 without causing additional damage thereto.

Although not pictured, the continued penetration of the target 5 by the broadhead assembly 10 may further include a rotation of the broadhead assembly 10 about the central longitudinal axis A thereof due to the manner in which the newly exposed second facets 48, 148 are at the forwardmost position of the broadhead assembly 10 while generally facing in opposing directions. For example, a force acting on the second facet 48 as a result of the penetration of the target 5 tends to be at least partially in a direction into the page from the perspective of FIG. 9 while a force acting on the second facet 148 as the result of the penetration of the target 5 tends to be at least partially in a direction out of the page from the perspective of FIG. 9. These forces acting on opposing sides of the central longitudinal axis A while facing in opposing directions tends to cause the broadhead assembly 10 to rotate about the central longitudinal axis A as the broadhead assembly 10 continues to progress through the target 5. This rotation of the broadhead assembly 10 causes further damage to the target 5 and once again prevents undesired removal of the broadhead assembly 10 without causing additional damage to the target 5.

The broadhead assembly 10 shown and described herein accordingly provides numerous advantageous features in comparison to the broadhead assemblies of the prior art. First, the broadhead assembly 10 requires very few parts, and the parts that are utilized can be placed in the configurations disclosed herein with minimal difficulty. Second, the prescribed actuation of the broadhead assembly 10 from the first position to the intermediate position and then from the intermediate position to the second position leads to maximized damage to the target 5 while further preventing undesired removal of the broadhead assembly 10 from the target 5 after penetration thereof. The manner in which the blades 14, 16 rotate outwardly also allows for fresh cutting surfaces to continually be exposed during the penetration of the target 5.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A broadhead assembly configured to actuate from a first position to a second position during a penetrating of a target, the broadhead assembly comprising:

a ferrule, the ferrule including a first shaft and a second shaft;

a first blade rotatably and slidably coupled to the ferrule, wherein the first blade includes a first slot and a second slot, wherein the first slot of the first blade extends rectilinearly from a first end to a second end, wherein the second slot of the first blade includes a rectilinear segment and a continuously formed arcuate segment, wherein the rectilinear segment of the second slot of the first blade extends from a first end to a second end, wherein the arcuate segment of the second slot of the first blade extends from the second end of the rectilinear segment of the second slot of the first blade, wherein the first slot of the first blade is arranged parallel to the rectilinear segment of the second slot of the first blade, wherein the first position of the broadhead assembly corresponds to the first shaft being disposed through the first end of the first slot of the first blade and the second shaft being disposed through the first end of the rectilinear segment of the second slot of the first blade; and a second blade rotatably and slidably coupled to the ferrule, wherein the second blade includes a first slot and a second slot, wherein the first slot of the second blade extends rectilinearly from a first end to a second end, wherein the second slot of the second blade includes a rectilinear segment and a continuously formed arcuate segment, wherein the rectilinear segment of the second slot of the second blade extends from a first end to a second end, wherein the arcuate segment of the second slot of the second blade extends from the second end of the rectilinear segment of the second slot of the second blade, wherein the first slot of the second blade is arranged parallel to the rectilinear segment of the second slot of the second blade, wherein the first position of the broadhead assembly further corresponds to the first shaft being disposed through the first end of the first slot of the second blade and the second shaft being disposed through the first end of the rectilinear segment of the second slot of the second blade the second blade.

2. The broadhead assembly of claim 1, wherein the first shaft defines an axis of rotation of each of the first blade and the second blade only when the first shaft is disposed through each of the second end of the first slot of the first blade and the second end of the first slot of the second blade, and wherein the second shaft is configured to traverse each of the arcuate segment of the second slot of the first blade and the arcuate segment of the second slot of the second blade when each of the first blade and the second blade are rotated about the first shaft.

3. The broadhead assembly of claim 2, wherein the first blade and the second blade rotate in opposing rotational directions.

4. The broadhead assembly of claim 1, wherein the first blade includes a longitudinal axis extending through a first pointed tip of the first blade, and wherein the second blade includes a longitudinal axis extending through a first pointed tip of the second blade, wherein the first slot of the first blade is arranged at an acute angle relative to the longitudinal axis of the first blade and the first slot of the second blade is arranged at an acute angle relative to the longitudinal axis of the second blade.

5. The broadhead assembly of claim 1, wherein the first slot of the first blade is arranged transverse to the first slot of the second blade when the broadhead assembly is in the first position prior to the broadhead assembly striking a target.

6. The broadhead assembly of claim 1, wherein the arcuate segment of the second slot of the first blade includes a radius of curvature measured from the second end of the first slot of the first blade, and wherein the arcuate segment of the second slot of the second blade includes a radius of curvature measured from the second end of the first slot of the second blade.

7. The broadhead assembly of claim 6, wherein the broadhead assembly is further configured to actuate to an intermediate position prior to the second position, and wherein the intermediate position of the broadhead assembly corresponds to the first shaft being disposed through the second end of the first slot of the first blade and the second end of the first slot of the second blade and the second shaft being disposed through the second end of the rectilinear segment of the second slot of the first blade and the second end of the rectilinear segment of the second slot of the second blade, and wherein the second position of the broadhead assembly corresponds to the first shaft being disposed through the second end of the first slot of the first blade and the second end of the first slot of the second blade and the second shaft being disposed through an end of the arcuate segment of the second slot of the first blade spaced apart from the rectilinear segment of the second slot of the first blade and an end of the arcuate segment of the second slot of the second blade spaced apart from the rectilinear segment of the second slot of the second blade.

8. The broadhead assembly of claim 1, wherein the first blade and the second blade are identical in structure, and wherein the second blade is rotated 180 degrees relative to the first blade about a central axis of the ferrule when the broadhead assembly is in the first position.

9. The broadhead assembly of claim 8, wherein the first blade includes a first pointed tip formed at an intersection of the first edge and the second edge of the first blade, and wherein the first blade further includes a lateral projection having an engaging edge formed at an end of the first edge disposed opposite the first pointed tip.

10. The broadhead assembly of claim 9, wherein the first blade includes a longitudinal axis arranged parallel to a central axis of the ferrule when the broadhead assembly is in the first position, wherein the first edge is disposed at a first angle relative to the longitudinal axis, the second edge is disposed at a second angle relative to the longitudinal axis, and the engaging edge is disposed at a third angle relative to the longitudinal axis, wherein the first angle is greater than the second angle and the third angle is greater than the first angle.

11. The broadhead assembly of claim 9, wherein the first edge and the engaging edge of the first blade are exposed when the broadhead assembly is in the first position, and wherein the second edge is indented relative to an exposed first edge of the second blade when the broadhead assembly is in the first position.

12. The broadhead assembly of claim 11, wherein the longitudinal axis of the first blade is arranged transverse to the central axis of the ferrule when the broadhead assembly is in the second position, and wherein the second edge is exposed and forward facing when the broadhead assembly is in the second position.

13. The broadhead assembly of claim 1, wherein the first position corresponds to a longitudinal axis of each of the first blade and the second blade arranged substantially parallel to a direction of travel of the broadhead assembly and the second position corresponds to the longitudinal axis of each of the first blade and the second blade arranged transverse to the direction of travel of the broadhead assembly.

14. The broadhead assembly of claim 1, further comprising an O-ring extending around the first blade and the second blade when the broadhead assembly is in the first position.

15. The broadhead assembly of claim 1, wherein the first blade includes a first pointed tip and a second pointed tip and the second blade includes a first pointed tip and a second pointed tip, wherein the first pointed tip of the first blade and the first pointed tip of the second blade are disposed adjacent each other when the broadhead assembly is in the first position, and wherein the second pointed tip of the first blade and the second pointed tip of the second blade are disposed adjacent each other when the broadhead assembly is in the second position.

* * * * *